United States Patent [19]

Cothary

[11] 4,228,877

[45] Oct. 21, 1980

[54] WHEELED SUITCASE WITH EXTENDABLE HANDLE MEANS

[76] Inventor: Walter G. Cothary, 178 Aileen Way, Grass Valley, Calif. 95945

[21] Appl. No.: 973,754

[22] Filed: Dec. 26, 1978

[51] Int. Cl.[3] ..... A45C 5/14; A45C 13/22

[52] U.S. Cl. ..... 190/18 A; 16/115; 190/18 R; 248/150; 280/37; 280/47.13 R

[58] Field of Search ..... 190/18 A, 18 R; 248/150, 151; 280/47.13 R, 37, 47.37 R; 16/115

[56] References Cited

U.S. PATENT DOCUMENTS

| | | | |
|---|---|---|---|
| 2,002,836 | 5/1935 | Rossi | 190/18 A X |
| 2,472,491 | 6/1949 | Quinton | 280/37 |
| 2,581,417 | 1/1952 | Jones | 190/18 A X |
| 3,063,667 | 11/1962 | Doty, Jr. et al. | 248/150 |
| 3,861,703 | 1/1975 | Gould | 280/47.13 R |

FOREIGN PATENT DOCUMENTS

| | | | |
|---|---|---|---|
| 141352 | 8/1949 | Australia | 190/18 |
| 2744322 | 12/1978 | Fed. Rep. of Germany | 190/18 R |
| 1444998 | 8/1976 | United Kingdom | 190/18 A |

*Primary Examiner*—Allan N. Shoap
*Attorney, Agent, or Firm*—Mark C. Jacobs

[57] ABSTRACT

A suitcase having retractable rolling means at the bottom is provided with a generally U-shaped handle means which is slidably received within generally triangular sleeves secured on the interior of said suitcase. The U-shaped handle may be extended when the suitcase is being wheeled along the ground. The handle means further includes collapsible legs to support the suitcase in a stationary position off the ground when said handle means is extended and said wheels are in operative position.

18 Claims, 11 Drawing Figures

WHEELED SUITCASE WITH EXTENDABLE HANDLE MEANS

BACKGROUND OF THE INVENTION

The field of invention pertains to luggage or suitcases and particularly with respect to suitcases having extendable wheel means thereon and retractable means associated therewith, which handle and wheel means when used in combination render the suitcase more easily portable.

DESCRIPTION OF THE PRIOR ART

Applicant is familiar with the following U.S. patents: Burtley No. 4,036,336; Walker No. 3,989,128; Gregg No. 3,948,365; Gould No. 3,861,703; Cassimally No. 3,960,252 and Stilger No. 2,925,283.

In these days of newly lowered airline fares, more and more people are traveling long distances for longer periods of time. When traveling for pleasure, people tend to require large suitcases to hold all of the things that they deem necessary to have when on a vacation trip. In many places throughout the country, and in fact the rest of the world, bell hops, sky caps and porters are not readily available to aid in the movement of luggage from one place to another within the terminal, parking lot, check-in area and the like, or a combination thereof. One suggestion to overcome the difficulty of physically carrying ones' own luggage has been the incorporation of wheels on the underside of the suitcase. Such wheels can be either permanently secured to the suitcase itself, or temporarily mounted thereupon. The problem with such temporary wheels is the fact that due to the normal rough handling in airplanes and trains, and the baggage movement conveyors, such wheels tend to become nicked, broken or even severed from the luggage. Standard gripping mechanisms such as straps associated with such suitcases also tend to become torn, frayed and severed from the suitcase. This is in addition to the fact that the presence of such a gripping mechanism is generally unaesthetic to the smooth lines of the suitcase.

SUMMARY OF THE INVENTION

The present invention provides a means of overcoming all of the problems associated with prior art, fixedly secured wheels and dangling gripping means for pulling such suitcases. The present invention provides a retractable rolling means at the bottom of the suitcase and a U-shaped extendable handle and support means which when returned to a non-operative position is flush with the body of said suitcase and is not subject to damage or deterioration from rough handling of the suitcase in transit. The handle thus conforms to the exterior appearance of the luggage and blends in with the smooth lines of same when not in use. The handle means also includes a nestable leg support which can be disengaged from the handle such that when in the operative position, it serves to support the suitcase in conjunction with the extended wheel means.

Accordingly, one object of this invention is to provide a means for rollably supporting luggage upon the ground, which means is completely hidden from view when not in use.

Another object is to provide a rolling means for a suitcase which is not subject to destruction while the luggage is in transit.

Still another object is to provide a device that will support the suitcase while the wheels are in a down position such that access may be readily made to the suitcase without having to retract the wheels.

Still yet another object of the invention to provide a suitcase which while being aesthetically pleasing, is functional as well as being readily transportable.

Other features and advantages of the invention will be apparent from the following detailed description in conjunction with the accompanying drawings.

DESCRIPTION OF THE PREFERRED EMBODIMENT

Figure 1:
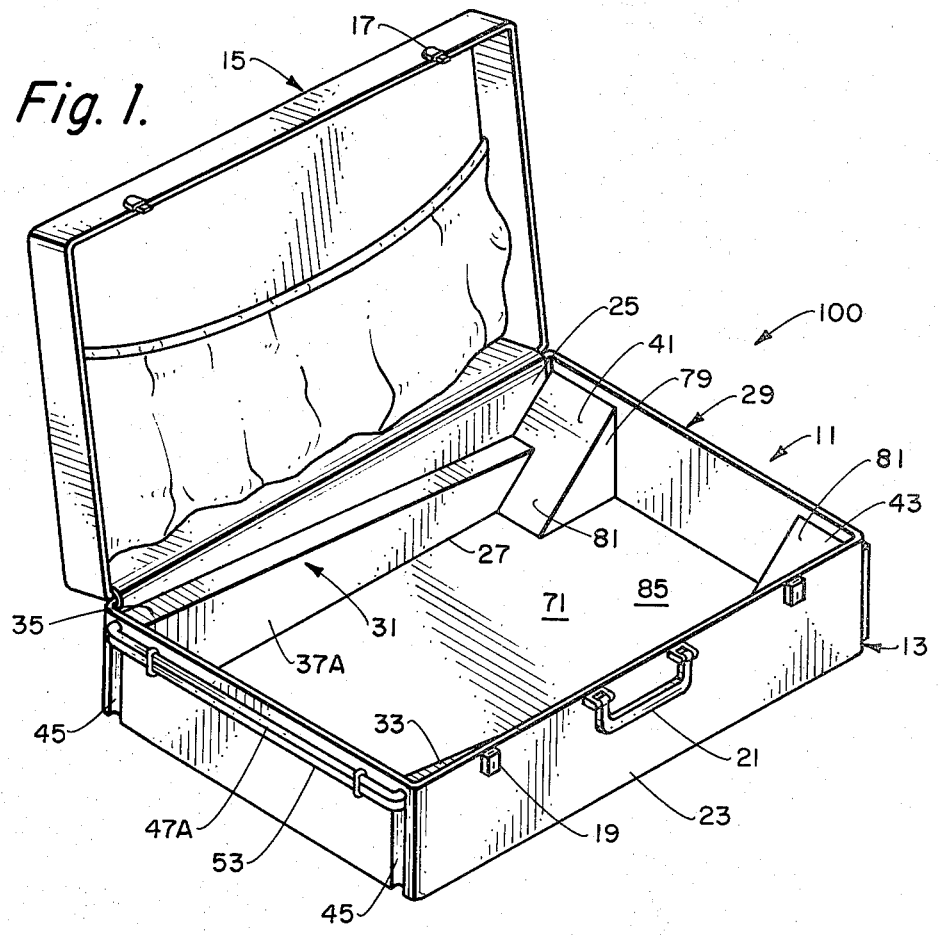
FIG. 1 is a perspective view of the suitcase of this invention showing the top in open position with both the wheels and the handle means retracted.

Referring now to the drawings and more particularly to FIG. 1, there is seen the device of this invention. This device includes a suitcase 11 which comprises a bottom compartment 13 comprised of a front wall 23, rear wall 25, each of which is spaced apart and joined on either end, one to the other, by left side wall 27 and right side wall 29 to define a compartment 71 closed off by bottom wall 85, which compartment is open at the top. Shown hingedly connected to rear wall 25, by hinges 39, is top 15.

Figure 5:
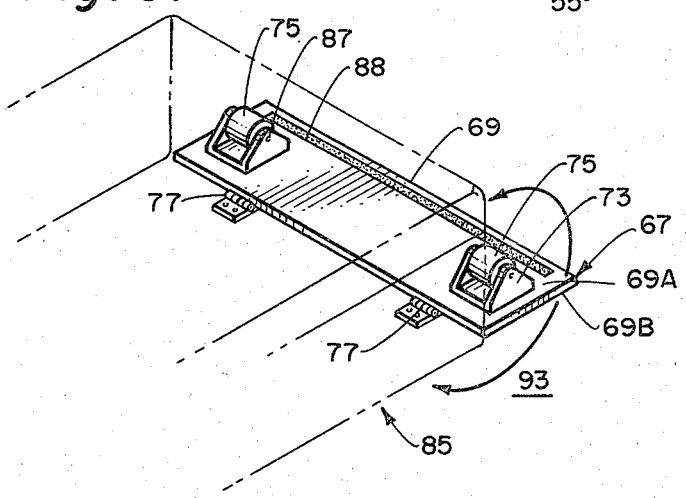
FIG. 5 is a bottom perspective view of the wheel plate assembly of this invention.

With reference to FIG. 5, there is shown wheel plate assembly 67 hingedly secured to the underside of compartment bottom 85. The wheel plate assembly 67 comprises a pair of spaced apart wheel brackets 73, each having a wheel 75 secured therein by conventional securing means such as a pin 87. Each of said wheel brackets 73 is rigidly secured by screws or bolts not shown to plate 69, which plate 69 is hingedly secured by hinges 77 at the edge of one side of bottom wall 85. Wheel plate assembly 67 is seen to rotate 270° from a closed position wherein plate 69 is in a generally vertical position with the wheels extending inwardly, being stowed in wheel wells 41 and 43 (as noted in FIG. 1 when non-operative to an operative position in parallel alignment with the outer side of bottom wall 85, with the wheels projecting downwardly towards the ground when in operative position. Wheel plate assembly 67 is hingedly secured to bottom wall 85 and is detachably secured to side wall 29 by the interengagement of Velcro strips 88 on the exterior of side wall 29 and strip 91 on the wheel containing side of the wheel plate assembly 67. Velcro is a well known means of securing one item to another, having been patented by Velcro S. A. Fribourg, Switzerland.

Returning to FIG. 1, it is seen that the rear end and front wheel wells, or wheel receiving compartments 41 and 43, comprise each an upstanding interior wall 79 secured to an upwardly disposed top wall 81. Each 81 is a mirror image to the other, each having a small cutout 83 and 83' whose length and width correspond to the walls 32 and 37 of handle receiving compartments 31 and 33.

In FIG. 1 wall 37 has been designated as **37*a* in view of the fact that said wall extends from its angular upper surface down to a position wherein said wall abuts the interior surface 85 of bottom 71. This is to be contrasted with the version shown in FIG. 6, wherein the handle receiving compartment 36 is seen to have the shorter vertically extended side wall 37*b* which would terminate in the dotted line 377 as opposed to the full length side wall 37*a* which depends to the inside surface 85 of bottom 71. The wall version shown in FIG. 1 employs a 37*a* type of side wall. In contrast thereto FIG. 3, if said side wall 37 had not been removed for clarity of understanding, said side wall would have been designated 37*b* if it merely covered the distance from bottom wall 34 to top wall 35 of handle receiving compartment 36**.

Figure 7:
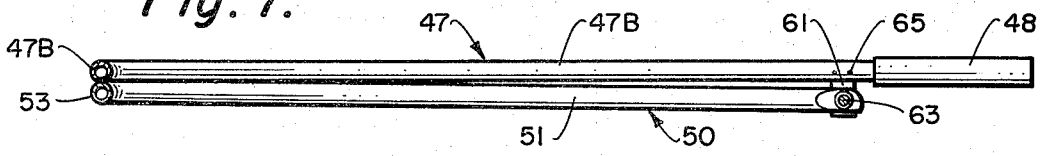
FIG. 7 is a close-up elevational view of the junction of the leg and handle of this invention, as also seen in FIG. 3.

Shown spaced apart and secured to upstanding wall 27 are arcuate receivers 45. Said receivers may be recessed or affixed upon the surface of said side wall 27. The purpose of said receivers 45 is to detachably retain leg portion 51 of support means 50 therein upon engagement therewith. This is better seen in FIG. 2. Leg 51 of support 50 is pivotally secured to long arm **47*b* of U handle 47. at the end thereof. Details of this junction are shown in FIG. 7** and will be discussed with respect to a discussion on that Figure.

It should be understood that if arcuate receivers 45 are recessed into wall 27, they must extend vertically upward along wall 27 no higher than would be the terminus of bottom wall 34 of handle receiving compartment 36. Otherwise it would interfere with the operation of said handle receiving compartment.

Shown in FIG. 1 secured to front wall 23 is handle 21 positioned approximately the top center thereof. Any conventional suitcase handle known to the art may be employed. The lower portion of each of the spaced apart hasps 19 are shown in both FIGS. 1 and 2. The upper portion of said hasps 17 are equally spaced apart and are adapted to engage lower portion 19 as is known to the art. Any suitable known hasp means may be employed.

To better illustrate the invention, front handle receiving compartment 33 and its associated wheel well 43 are shown in phantom in FIG. 1.

Figure 2:
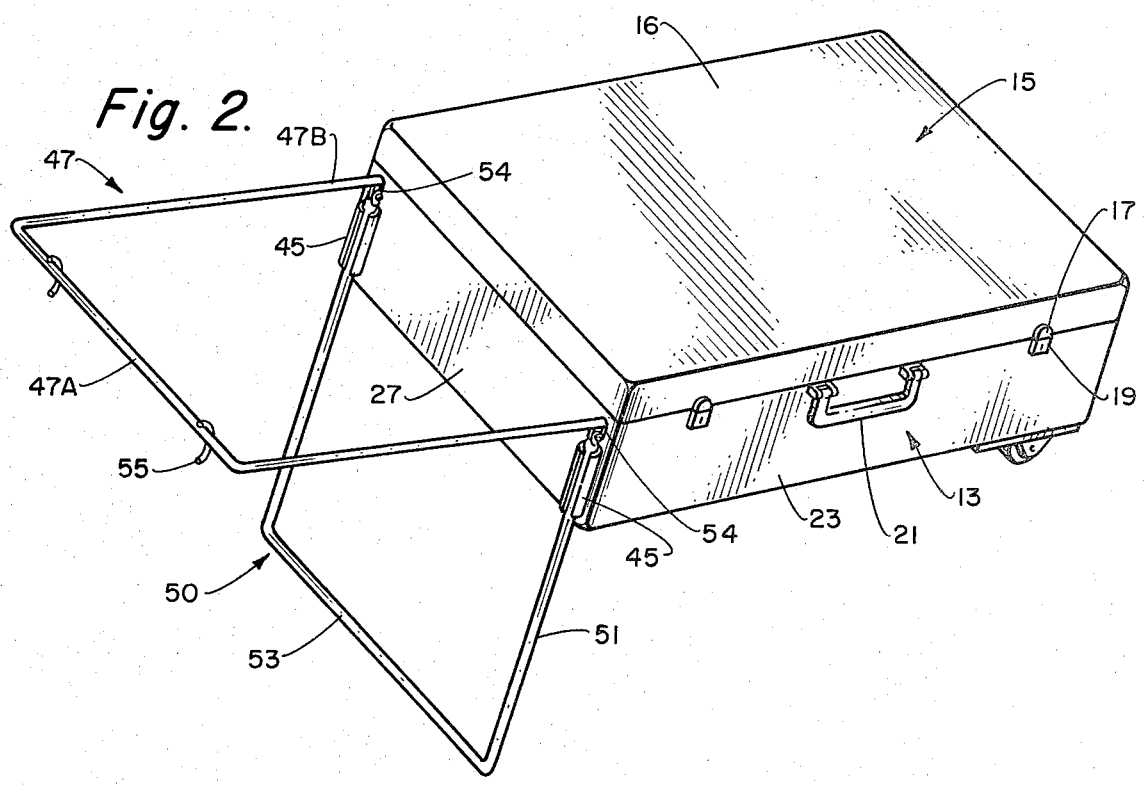
FIG. 2 is a perspective view of the suitcase of this invention wherein the handle and leg support means are extended, and the wheels are in their operative position.

In FIG. 2 the suitcase of this invention is shown in closed position with the wheel plate assembly oriented 270° into its operating position. U handle 47 comprising the short arm **47*a* and the long arm 47*b* are shown fully extended and ready to be utilized by the suitcase owner if desired to move said case by pulling or pushing of same. Handle 47*a* may be covered with a material to intensify the grip ability thereof such as leather or vinyl wrapping not shown. Support 50 comprising cross brace 53 and legs 51 depend vertically from said U handle 47 for engagement with the ground by said cross brace 53. Each of said spaced apart legs 51 are detachably secured in place abutting the wall 27 by arcuate receivers 45, sized slightly larger in cross section than said legs 51. Arcuate receivers are secured as by screws to wall 27 and are constructed of a flexible material such as polyvinyl chloride tubular sections with a portion thereof removed along the length thereof. Support 50 may be made of one bent piece of tubing having two right angles therein or welded joints may be used to join individual components 50 and 51. U handle 47 may also be constructed of one tubular member as shown in FIG. 2** or three individual components may be joined by the use of welded joints as would be known to the art.

Retainers 55, such as a belt, may be optionally employed to secure short arm **47*a* to cross brace 53 when said support 53 is extended adjacent said U handle 47 for movement of the suitcase forwardly or backwardly to prevent the downward disposition of support 50 toward the ground when both are fully extended. U handle 47 and support 50 may be moved inwardly and outwardly into compartments 31 and 33 through FIG. 8 configured aperture 54, best seen in FIG. 2. This aperture extends through the wall 27 in alignment with the end openings of receiving compartments 31 and 33. Said aperture is sized slightly larger than the diameter of the tubular members 47*b* and 51**.

Figure 4:
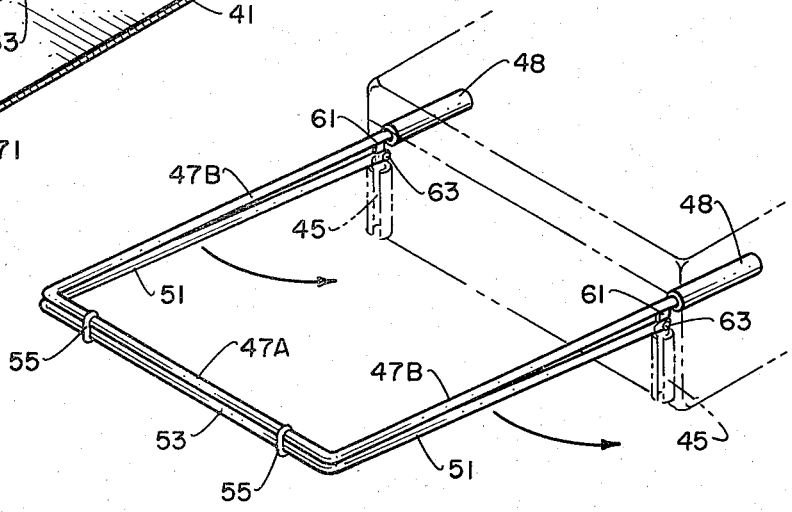
FIG. 4 is a detailed perspective view of the handle assembly of this invention with the leg supports in their non-operative position.

In FIG. 4 U handle 47 and support 50 are seen to be both extended outwardly from said suitcase in a plane generally equal to the angle of the diagonal formed by extending a line from the bottom corner of side 25 (behind the wheel well 41) to the top corner of the opposite side of side 25. In this position the suitcase may be transported readily as opposed to the stop or storage position as depicted in FIG. 2 wherein the suitcase may be opened quite readily by the owner thereof. As indicated previously the means of joining leg 51 to long arm **47*b* will be discussed with respect to the discussion of FIG. 7**.

Figure 3:
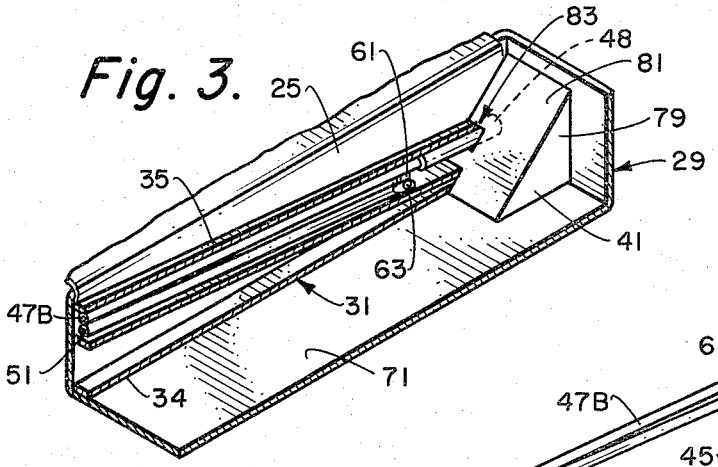
FIG. 3 is a close-up perspective view of a portion of the interior of the suitcase of this invention.

In FIG. 3 there is shown the details of the construction of the disposition of long arm **47*b* and leg 51 within rear handle receiving compartment 31. Said handle receiving compartment includes an angularly disposed top wall 35 disposed downwardly from left to right and bottom wall 34 positioned in like manner parallel to top wall 35. Each of said top and bottom walls 31 and 35 abut the rear wall 25. Walls 34 and 35 extend from the interior surface of wall 27 on one side and at the cut out 83 of angled top wall 81 of rear wheel well 41**.

Wheel well 41 is seen from the figures to comprise an angled front wall 81, having a generally inverted L shaped cutout 83 therein and extending from the junction of walls 25 and 29 a suitable distance along the length of said wall 29. Angled top wall 81 is rigidly secured to wall 29 at the top end thereof and to the inside 71 of bottom wall 85. Generally triangular end wall 79 is secured to bottom interior 71, the inside of wall 29 and along the edge of angled top wall 81.

As previously mentioned, wheel well 43 is a mirror image thereof and extends from front wall 23 toward rear wheel well 41 and is spaced apart therefrom.

For ease of understanding, upstanding side wall 37, be it version **37*a* or 37*b*, has been deleted from this figure in order to observe the parts which are found within said rear handle receiving compartment 31**.

Shown disposed within compartment 31 are tubular members 47*b* and 51. Member 51 is seen to be connected pivotally to tube 47B by pivot pin 63 through joinder plate 61. Extensions 48 positioned on the ends of members 47B and sized larger in cross section serve to retain members 47B within compartment 31, in part as extensions 48 are larger than openings 54 as seen in FIG. 2. Details of this connection of members 47 and 51 is seen in FIG. 7. Thus joinder plate 61 further employs screws 65 for the attachment of said plate to member 47. To provide rigidity to the two members when they are extended, extensions 48 are positioned on the ends of members 47B and sized larger in cross section.

Turning now to FIG. 5. Shown in phantom is a portion of suitcase 11. In this figure no portion of right side wall 29 is seen. This wall is shown entirely in phantom such that the relationship of parts which abut or adjoin to wall 29 may be readily seen in the relationship that they assume in the total structure. Shown in said figure is wheelplate assembly 67. In the position shown in the drawing, said wheelplate assembly is in neither its fully open nor fully closed position. In this view, to be in a fully closed position plate 69 would be in a position whereby surface 69*a* would be in an abutting relationship to right side wall 29. On the other hand, when in a fully open position, such as shown by arrow 93, surface 69*b* would be arced around, parallel to and abutting, the underside 14 of bottom wall 85. Thus, wheelplate assembly 67 is seen to comprise plate 69 having a top surface 69*a* and a bottom surface 69*b*. Secured to and spaced apart therefrom are a pair of wheel brackets 73, each having a wheel 75 disposed between the upturned flanges of said wheel brackets 73. Each of said wheels is held between the wheel brackets by pin 87 and a suitable locking nut not shown. Also not shown are bearing means to aid in the rollability of wheel 75. Such caster devices comprising the wheel and the mounting means of bracket 73 are known to the art, as is the means of securing same as by screws and bolts, or adhesive pads, to plate 69.

Figure 8:
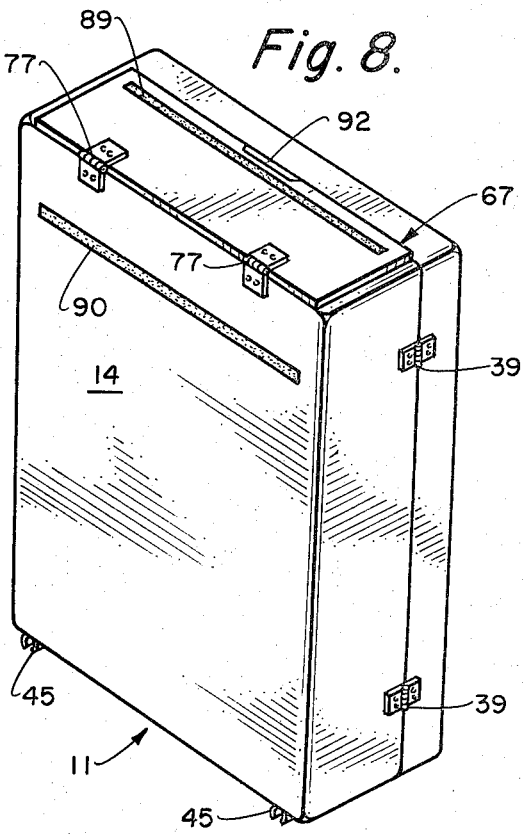
FIG. 8 is a perspective view of the suitcase of this invention showing the bottom and the side having the wheel plate assembly abutting thereupon.

Velcro® strip 88 is shown secured as by adhesion to top surface 69*a* along the length thereof at the distal end of said wheelplate assembly. Hinge means 77 secure wheelplate assembly 67 to suitcase 11. The portion of the hinge 77 not attached to the wheelplate assembly may be secured either to side wall 29 or to bottom wall 85. There being no criticality to the choice, the choice being dependent upon the type of hinge employed. The only requirement being that wheelplate assembly 67 be capable of 270° rotation. On the underside of plate 69, not viewable in FIG. 5, but readily seen in FIG. 8, is a second Velcro® strip 89 which upon the 270° rotation of assembly 67 is adapted to engage a third Velcro® strip 90 shown on the underside of bottom wall 85, namely surface 14. Velcro®, as is known in the art, comprises a series of woven nylon or other polymeric material loose on the female section which are adapted to engage a male section comprising a plurality of woven hook elements. The product is manufactured by Velcro U.S.A. under license from Velcro of Fribourg, Switzerland.

Figure 6:
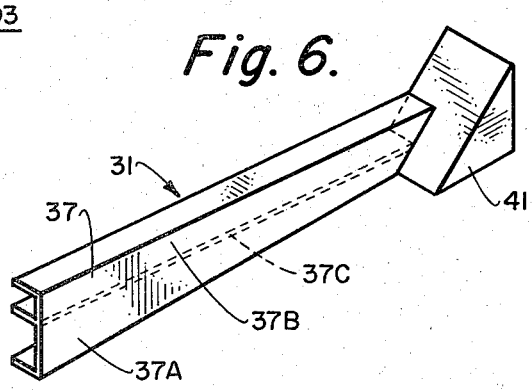
FIG. 6 is a front perspective view of a portion of the interior of the suitcase of this invention.

In FIG. 6 there is shown a construction similar to that in FIG. 3. However, in FIG. 6 both the short version of side wall 37, namely 37*b*, and the total version, namely 37*a*, is shown. These side walls are employed in the construction of rear handle receiving compartment 31. Dotted line 377 represents the vertical extension of wall 37*b* as contrasted to the overall wall 37*a*, when that embodiment is employed. Wheel well 41 is also seen in this Figure.

The details of FIG. 7 have been set forth previously in conjunction with the discussion of FIG. 3.

Turning back momentarily to FIG. 8, there is also seen in this figure which depicts suitcase 11 in an upside-down elevated position with arcuate receivers 45 on the ground, and wheelplate assembly 67 in the air. The figure is so depicted in order to demonstrate to the reader the manner in which wheelplate assembly attaches to Velcro® strip 90 on underside 14 of bottom 85. The arcuate receivers 45 are seen to frictionally engage members 51 when members 51 are fully extended from receiving compartments 31 and are oriented downwardly in order to secure members 51 in a rest position as is seen in FIG. 2. These arcuate receivers may be surface mounted as is shown in FIGS. 2 and 8, or in turn, they may be designated 455 and formed as part of wall 27 on the outward facing side thereof. Such a construction wherein 455 is a recessed portion of wall 28 is depicted in FIG. 1.

Figure 9:
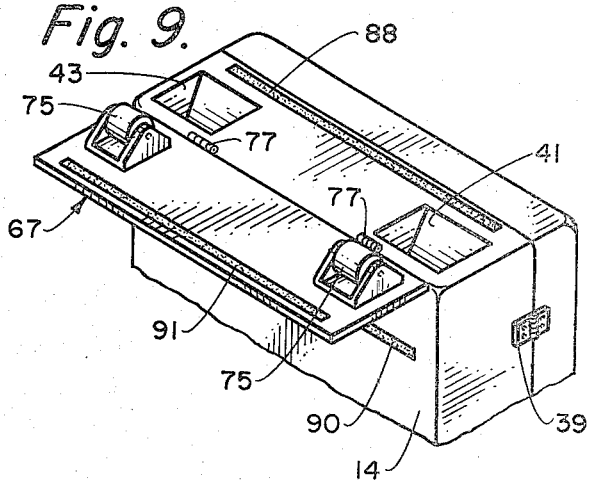
FIG. 9 is a top plan view showing one side of the suitcase of this invention, with wheel wells therein and the wheel plate assembly hingedly secured thereto and spread apart therefrom.

FIG. 9 is a top plan view showing one side of the suitcase of this invention wherein the wheel wells 41 and 43 are shown therein. The wheelplate assembly 67 is seen hingedly secured to right side wall 29 and spread apart in a single plane with said wall 29. This intermediate position is neither secured for stowage of the wheels, nor is it an operating position for rolling the suitcase 11. Rather, it is a position utilized strictly to illustrate the invention.

Figure 10:
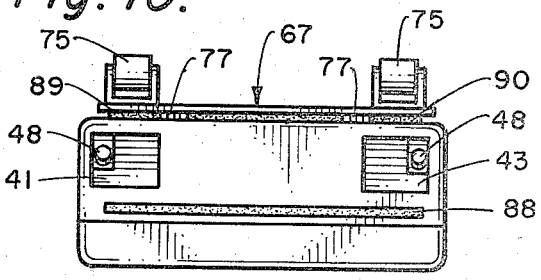
FIG. 10 is a top plan close-up view of one of the wheel wells as seen in FIG. 9.

In this Figure also shown spaced apart from each other in parallel alignment are Velcro® strips 88 secured to the body of the suitcase and 91 which is on the distal edge along the length thereof of plate 69 on top surface 69*a*. When plate 69 is oriented 180°, it is seen that the wheels 75 in their bracket 73, which are spaced apart a suitable distance to coordinate with the spacing of the wheel wells 41 43 from each other, fit into said wheel wells, and that the Velcro® strips 91 and 88 will engage each other to thereby secure plate 69 to wall 29 releasably. Wheels 75 are preferably made of polyurethane and as such wheels suitable for use on skateboards may be employed as wheels 75. Wheel wells 41,43 are similar in construction but are mirror images of each other. The details of wheel well 41 are seen in FIG. 10.

Wheel well 41 is seen to be of a generally triangular shape and being recessed into the body of suitcase 11. The well comprises a pair of downwardly extending triangular wall 41*d* and 41*b* which intersect at a right angle wall 41*c*. The hypotenuse side of said triangle is designated 41*a*. Reference is also made to FIG. 6 wherein the sloping front side 41*a* and triangular side wall 41*b* are seen. Projecting inwardly from said suitcase into said wheel well 41 are walls 35 and 37 of compartment 31. This is best seen in FIG. 3 wherein said side walls protrude through cutout 83 in wall 81. Disposed within the L-shaped section formed by the junction of walls 37 and 35 is extension 48. The relative location of the front edge of extension 48 is such that it will not interfer with the egress and ingress of wheel 75 from said wheel well 41.

Figure 11:
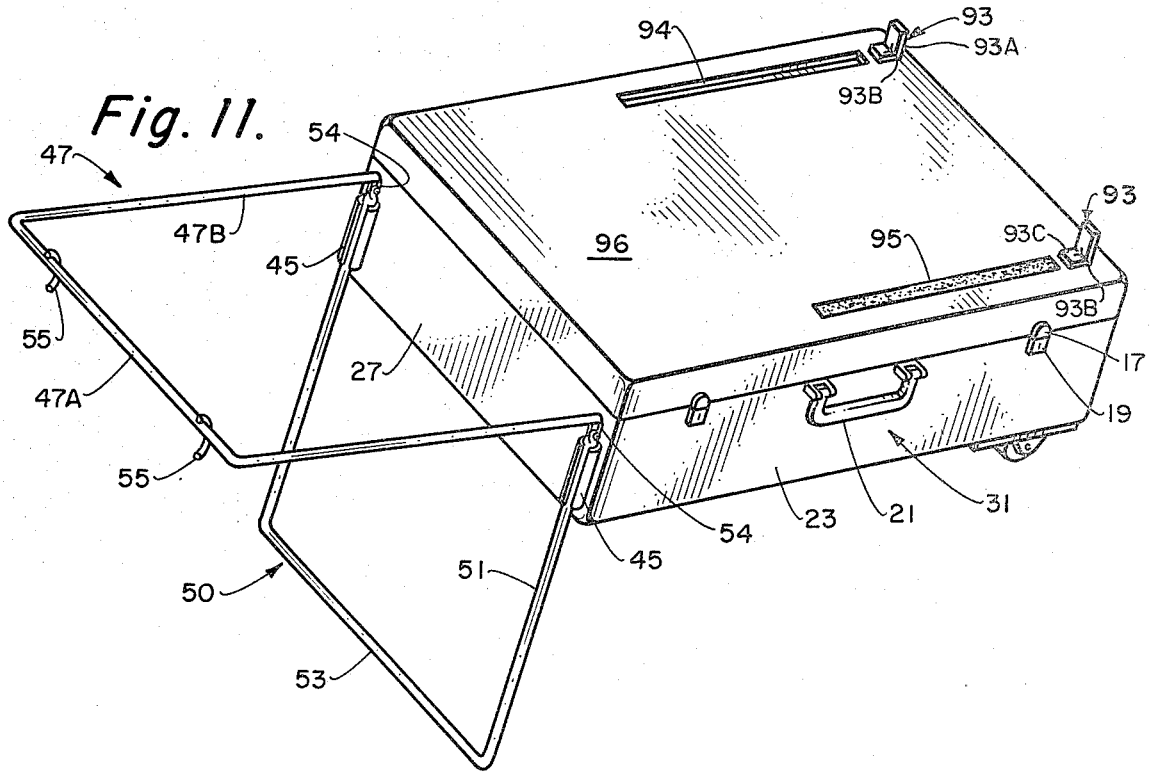
FIG. 11 is a top perspective view of the suitcase of this invention with the U-shaped handle and leg support in their extended positions.

In FIG. 11 there is seen a perspective view of suitcase 11 shown in a rest position. Handle 51 is shown secured in an arcuate recess 455 as per the embodiment of FIG. 1. Further to be seen are spring loaded hinge stops 93 shown spaced apart from each other in axial alignment on the distal side of top surface 96 of suitcase top 15. In normal operating situations said hinges are secured in a closed position. However, when it is desired to rest a second suitcase on the top of the primary suitcase 11 in order to transport the second suitcase at the same time, hinge stops 93 are raised to their open position such that the stop portion 93*a* becomes disposed upwardly from said surface 96. The second suitcase may be removably secured from primary suitcase 11 in one of three ways. The suitcase may merely be placed on top surface 96 to rest and abut against hinge stops 93. While this is sufficient to retain the second suitcase in a resting position upon the primary suitcase, if the operator should incline the lower suitcase at too great an angle, or if the upper suitcase is incorrectly packed, there is a possibility that merely by employing hinge stops 93 that the top suitcase could pitch forwardly. Accordingly, it is preferred to dispose a layer of Velcro ® 95 across at least a portion of the top surface 96 of the top of the suitcase 15. The upper, or secondary suitcase, would have a coextensive matching Velcro ® strip at a suitable location on the underside thereof and adapted to engage strip 95 such that top suitcase would releasably attached to surface 96. As an alternate thereto, there is shown a depressed section 94 which is a generally rectangular recessed area within the top 15 of said suitcase 11. Such a recessed area 94 would be employed along the length of 96, or preferably a plurality of same would be so disposed such as at the location shown of 95 and where actually depicted as 94, figured and sized member(s) secured on the underside thereof and said members would be adapted to be releasably positioned to frictionally engage the side walls of said depressions such as to hold or retain the upper suitcase within the depressions 94 of said lower suitcase. The disadvantage of the second embodiment is the fact that all prior art suitcases would require modification to include such generally rectangular leg portions as previously described capable of interengaging with recess sections 94. Whereas, if the Velcro ® embodiment is adopted, any prior art suitcase can be readily modified with minimal effort to rest upon and be carried with the suitcase 11 of this invention. While only one Velcro ® strip 95 and only one depressed section 94 are shown in FIG. 11. It is obvious that a plurality of either of these may be employed, and as the directionality of such depressed sections or Velcro ® strips is a matter of choice. It is further seen that while there is no particular advantage to same that a suitcase could be constructed having one depressed section and one Velcro ® strip as shown in actuality of FIG. 11.

That while not shown in Figures, it is within the scope of the invention to also employ an extra handle 21 on side panel 27. Such extra handle would be suitable for a trunk or large suitcase such as to aid in the handgrasping of such suitcase.

While two wheel receiving compartments 41 are disclosed to be used in conjunction with two wheels 75, it is obvious that more or less than two wheels and wheel receiving compartments may be employed.

While each wheel bracket 73 is shown to include only one wheel 75, it is obvious that a plurality of such wheels may be mounted in parallel alignment within said bracket, if so desired.

While Velcro ® strips 89 and 90 have been disclosed particularly with reference to FIG. 8 as the mode of securing wheel plate assembly 67 in operative position after being released from the storage position as shown in said FIG. 8. Such alternative securing means include male and female snaps disposed on the exterior surface of wheel plate assembly 67 and base 14.

Finger grip 92 disposed above said Velcro ® strip 89 is to aid the operator in both stowing the wheelplate assembly 67 in storage position and in releasing said plate from said storage position.

I claim:

1. A traveling suitcase comprising a top section and a bottom section, said bottom section having upstanding opposed front and rear walls, and first and second opposed side walls, all normally intersecting at their extremities and a base perpendicular to each of said walls, thus defining a box, a pair of spaced apart openings in the first of said side walls, each communicating with one of a pair of elongated laterally spaced apart handle receiving compartments, both of which compartments are disposed along the interior surface of one each of said front and rear walls, respectively, at least one wheel receiving compartment disposed along the interior surface of the second of said walls with access thereto being from the exterior of said second side wall, a pair of openings in said second side wall one of which communicates with each wheel receiving compartment, a wheelplate assembly comprising a plate having at least one wheel bracket mounted thereon, with at least one wheel rotatably mounted in said bracket, the number of brackets corresponding to the number of wheel receiving compartments, said plate being hingedly secured to said bottom section, and releasably orientable from a storage position to an operative position, said wheels and brackets being adapted to fit into said wheel receiving compartments, when said plate is in the storage position and, an extendable handle member having a pair of interconnected arms each extendably secured within a respective handle receiving compartment, an extendable support member having a pair of parallel extendable legs each extendably secured within a respective handle receiving compartment, each leg being pivotally connected to one of said arms at the extremity of each arm and leg, said legs adapted to pivot upon extension with said arms to a generally normal position to said arms, from the connection at the extremity of each of said legs with each of said arms.

2. The suitcase of claim 1 wherein the extendable handle member is joined at one end thereof by a perpendicular connector to form a U-shaped handle.

3. The suitcase of claim 2 including means mounted on the exterior of the top section to releasably secure a second suitcase thereto.

4. The suitcase of claim 2 wherein said legs are connected at the outer ends thereof to form a U-shaped stand.

5. The suitcase of claim 4 further including arcuate receivers on the first of said side walls adapted to releasable engage said legs upon the extension and vertical orientation thereof.

6. The suitcase of claim 4 having two wheel receiving compartments, one of which is disposed at the junction of said second side wall with said rear wall and the other at the junction with said front wall.

7. The suitcase of claim 6 including means on said second side wall and on said base adapted to cooperate with means on said wheelplate assembly to releasably secure said assembly to either said second side wall or said base.

8. The suitcase of claim 7 wherein there are two wheel brackets each of which has one wheel rotatably mounted therein.

9. The suitcase of claim 7 wherein the wheels are polyurethane.

10. The suitcase of claim 1 including a pair of complimenting Velcro® strips disposed along both the top edge of the exterior surface of said second side wall, and the top edge of the surface of said plate having the wheels mounted thereon to releasably secure said plate in a storage position.

11. The suitcase of claim 10 further including means to releasably secure said wheelplate assembly to said base in an operative position.

12. The suitcase of claim 10 including a finger grip on the exterior of said plate.

13. A traveling suitcase comprising a top section and a bottom section, said bottom section having upstanding opposed front and rear walls, and first and second opposed side walls, all normally intersecting at their extremities and a base perpendicular to each of said walls, thus defining a box a pair of spaced apart openings in the first of said side walls, each communicating with one of a pair of elongated laterally spaced apart handle receiving compartments, one of which compartments is disposed along the interior surface of each of said front and rear walls, two wheel receiving compartments disposed along the interior surface of the second of said walls with access thereto being from the exterior of said second side wall, a pair of openings in said second side wall one of which communicates with each of said wheel receiving compartments, a wheelplate assembly comprising a plate having two wheel brackets mounted thereon, with one wheel rotatably mounted in each bracket, said plate being hingedly secured to said bottom section, and releasably orientable from a storage position to an operative position, each wheel and bracket being adapted to fit respectively into its own wheel receiving compartment when said plate is in the storage position, and a pair of extendable arms forming a handle member and each extendably secured one per compartment within said handle receiving compartments.

14. The suitcase of claim 13 wherein one of said wheel receiving compartments is disposed at the junction of said second side wall with said rear wall and the other at the junction with said front wall.

15. The suitcase of claim 14 wherein said wheel receiving compartments are generally right angle triangular in shape, with an upwardly and outwardly extending top wall as the hypotenuse of said triangle, said handle receiving compartments extending longitudinally from the interior of surface of said first side wall to the hypotenuse of its corresponding wheel receiving compartment.

16. A traveling suitcase comprising a top section and a bottom section, said bottom section having upstanding opposed front and rear walls, and first and second opposed side walls, all normally intersecting and a base perpendicular to all of said walls, defining a storage area, a pair of spaced openings in one of said side walls, one each near the junction of said side wall with said front and rear walls, each opening communicating with a compartment within said storage area, an extendable U-shaped handle slidably disposed in said openings into the compartments, means mounted within said storage area on said handle to prevent overextension thereof, a generally U-shaped leg stand pivotably secured to said handle and extendable therewith from said storage area, and a releasably securable hinged wheelplate assembly disposed parallel to the exterior surface of said second side wall in a storage position and orientable therefrom to an operative position parallel to said base.

17. The suitcase of claim 16 further including means to releasably secure said wheelplate assembly to said bottom section in an operative position.

18. The suitcase of claim 16 further including means mounted on said handle to releasably secure said leg stand to said handle, and means on said first side wall to releasably secure said leg stand to said side wall.

* * * * *